United States Patent [19]

Critchley

[11] Patent Number: 5,017,899

[45] Date of Patent: May 21, 1991

[54] CIRCUIT BREAKER

[75] Inventor: Martin Critchley, Gwynedd, Great Britain

[73] Assignee: Delta Circuit Protection & Controls Ltd., England

[21] Appl. No.: 315,337

[22] Filed: Feb. 24, 1989

[30] Foreign Application Priority Data

Feb. 27, 1988 [GB] United Kingdom ..... 8804645

[51] Int. Cl.[5] ..... H01H 9/00; H01H 9/20

[52] U.S. Cl. ..... 335/172; 335/167

[58] Field of Search ..... 335/23, 35, 26, 168, 335/171, 173, 174, 175, 176, 169, 170, 172, 167

[56] References Cited

U.S. PATENT DOCUMENTS 3,081,386 3/1963 Koenig et al. ..... 335/23

4,514,709 4/1985 Nakano et al. ..... 335/23

4,641,001 2/1987 Fujihisa et al. ..... 335/23

*Primary Examiner*—Steven L. Stephan

*Assistant Examiner*—Nilay H. Vyas

*Attorney, Agent, or Firm*—Andrus, Sceales, Starke & Sawall

[57] ABSTRACT

A circuit breaker wherein a linkage transmits movements of a manual operating lever to a movable contact for moving the movable contact against a spring bias into engagement with a fixed contact. The linkage is arranged to hold the movable contact in an "ON" position and a releasable latch couples the linkage and the movable contact. A fault detector can effect release of the latch to permit the movable contact to move under the action of its spring from engagement with the fixed contact independently of movement of the linkage and the lever.

7 Claims, 5 Drawing Sheets

CIRCUIT BREAKER

Figure 1:
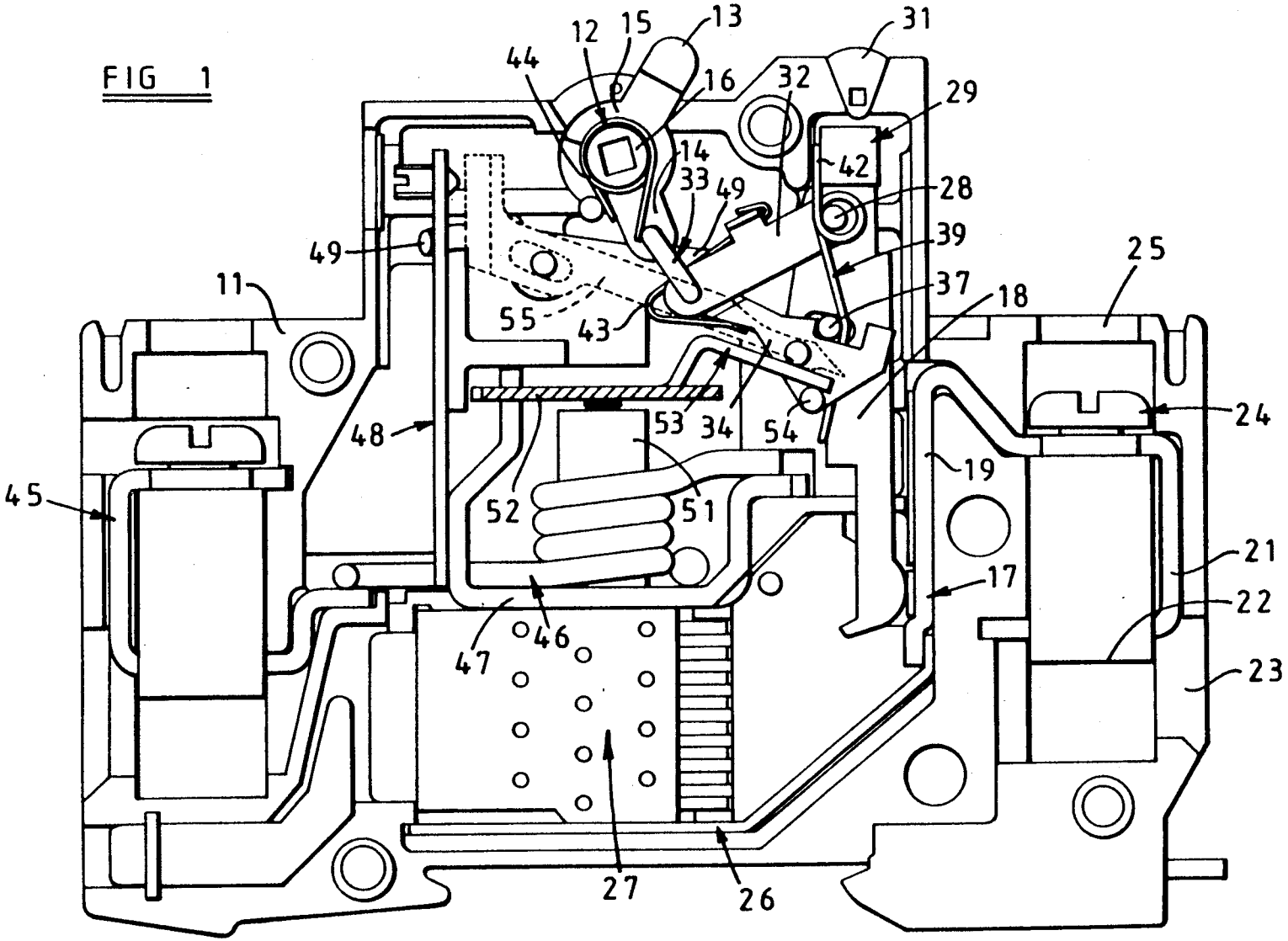

This invention relates to a circuit breaker for use in a domestic electricity supply and similar applications for example commercial and light industrial applications. The invention is particularly, but not exclusively, associated with miniature circuit breakers, but can also find application in, for example, a combined residual current device and miniature circuit breaker.

The term miniature circuit breaker (M.C.B.) is here used to denote a circuit breaker for use in a consumer unit of a domestic electricity supply. A conventional M.C.B. includes fixed and movable contacts, the movable contact being movable into and out of engagement with the fixed contact by means of a manually operable control lever. A resiliently loaded over-centre linkage transmits movement of the manual operating lever to the moving contact to move the moving contact in accordance with movement of the lever and a releasable latch mechanism is associated with the linkage and is operable to release the linkage for return movement of the linkage, the lever, and the moving contact to an "OFF" position. The releasable latch mechanism may be operated by any one of a number of different fault sensors, for example, the M.C.B. may include a bimetal release and an electromagnetic release both of which are sensitive to fault conditions.

A disadvantage of the above conventional M.C.B. is a relatively slow reaction time, that is to say the length of time taken for the contacts to open after a fault condition has been reacted to, and the releasable latch mechanism being operated. The relatively slow reaction time is attributable to the inertia of the components which must move to achieve contact opening, and it is an object of the present invention to provide a circuit breaker wherein the above mentioned problem is minimised.

In accordance with the present invention there is provided a circuit breaker comprising a fixed contact, a movable contact, resilient means operable to urge the movable contact away from the fixed contact, a manually operable lever for moving the movable contact into and out of engagement with the fixed contact, a linkage for transmitting movement of said lever to said movable contact and for holding said movable contact in engagement with said fixed contact in an "ON" position of said lever, releasable latch means coupling the linkage and the movable contact, and fault detection means for releasing said latch means and so disengaging said moving contact from said linkage for movement under the action of said resilient means independently of movement of said linkage.

Preferably said latch means includes a latch member movable with said linkage, and a pin engagable by said latch member and extending transversly of the moving contact, said pin being movable by the latch member during movement of the linkage towards its "ON" position, and there being a resilient element through which movement of the pin arising from movement of the linkage towards its "ON" position is transmitted to the moving contact to move the moving contact towards the fixed contact, said latch member being disengageable from said pin to permit movement of the moving contact away from the fixed contact.

Desirably said moving contact engages said fixed contact before said linkage reaches its "ON" position, and said resilient element is stressed by movement of the pin after the moving contact engages the fixed contact so as to generate contact pressure.

Preferably said resilient element, after disengagement of said latch member from said pin, applies force through said pin to said moving contact to move the moving contact away from the fixed contact.

Preferably said pin extends through an elongate slot in the moving contact.

Desirably said fault detection means includes an electromagnet which, when energized, actuates said releasable latch means by way of an electromagnet armature.

Conveniently the electromagnet is positioned with its axis generally parallel to the length of the moving contact.

Alternatively the electromagnet is positioned with its axis generally transverse to the length of the moving contact and said armature is coupled thereto by way of stirrup means whereby the armature can move the moving contact away from the fixed contact.

Figure 2:
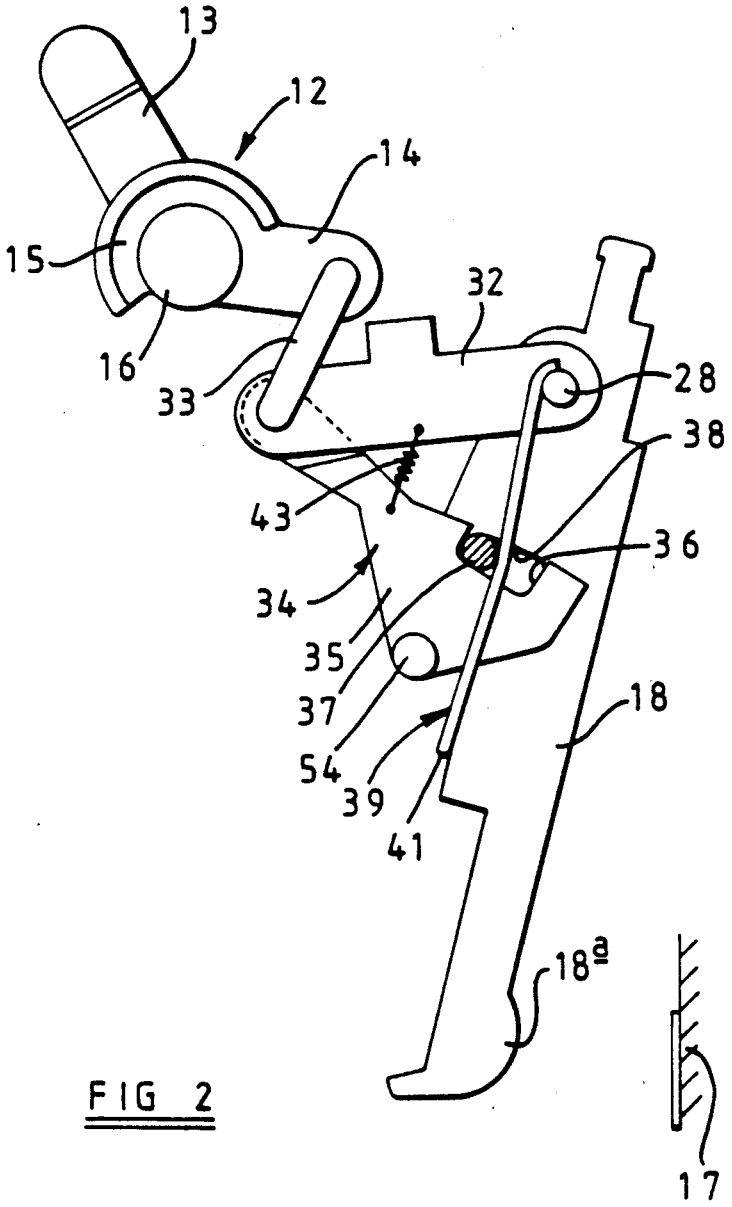
Figure 3:
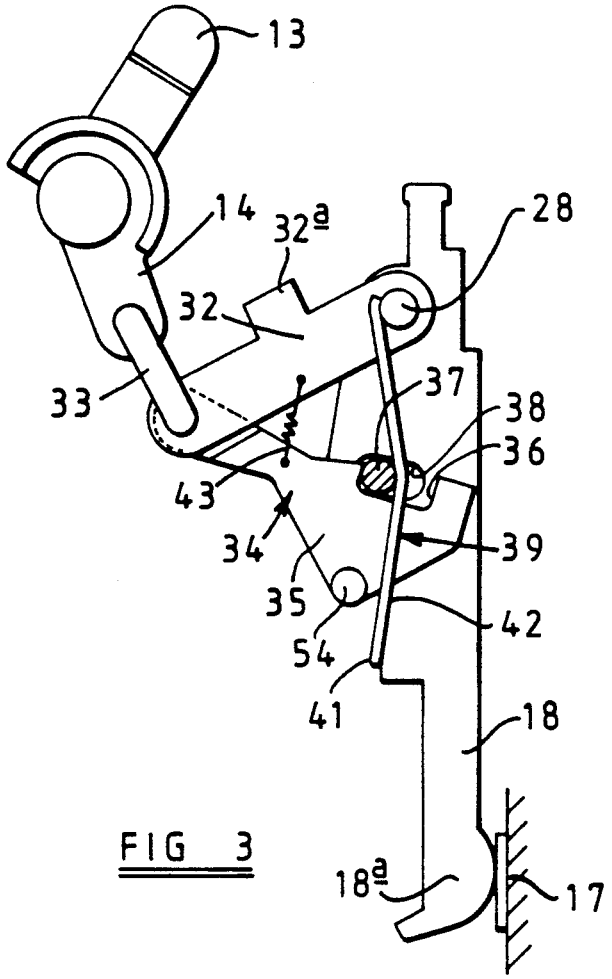
Figure 4:
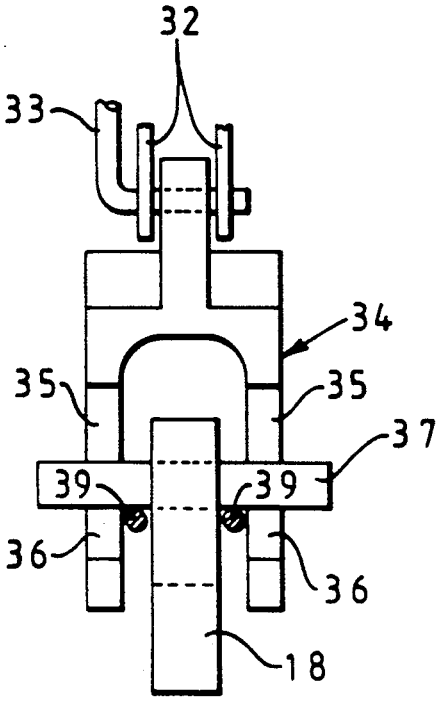
Figure 5:
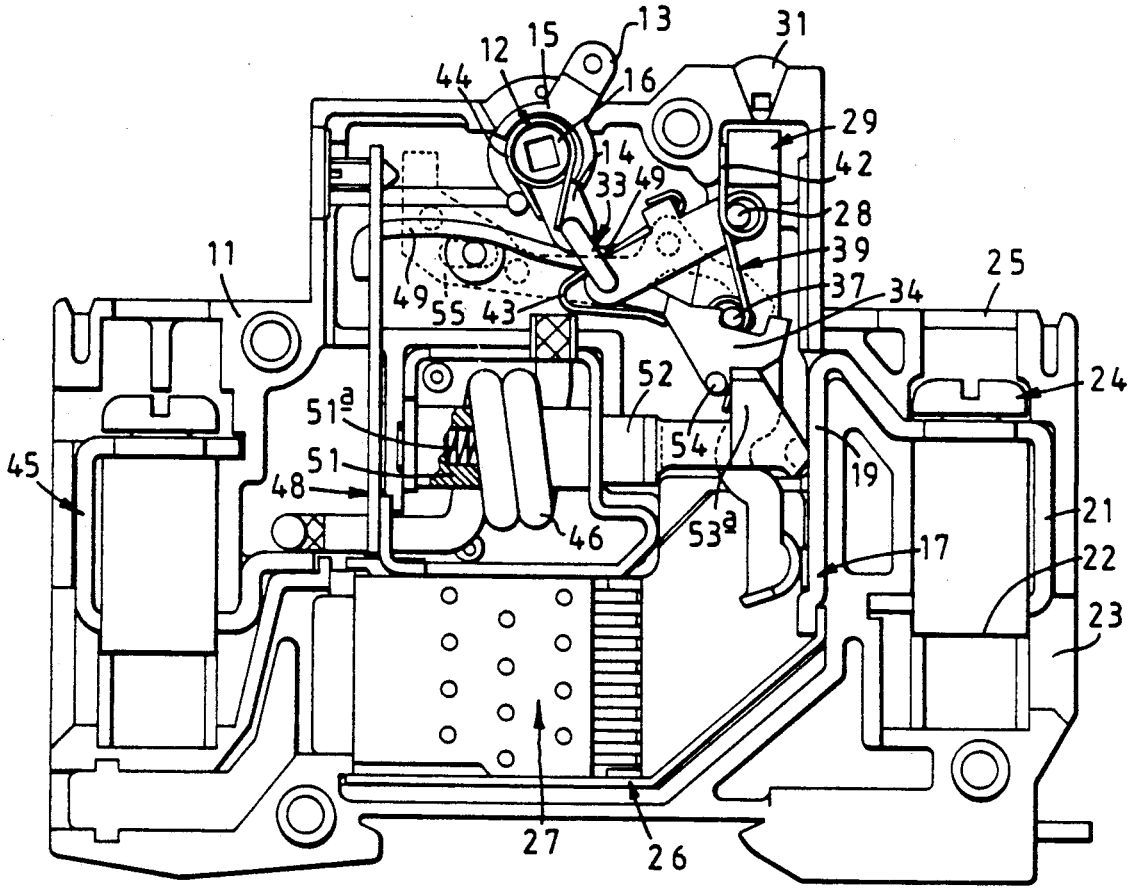
Figure 6:
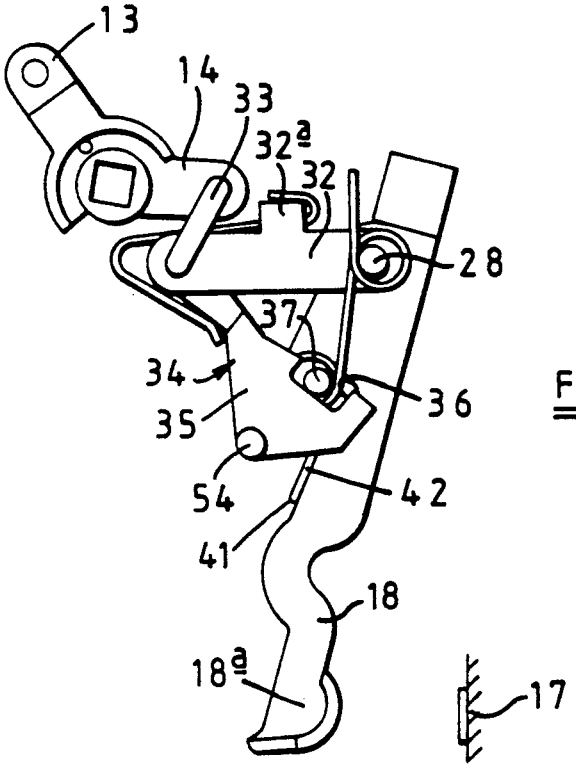
Figure 7:
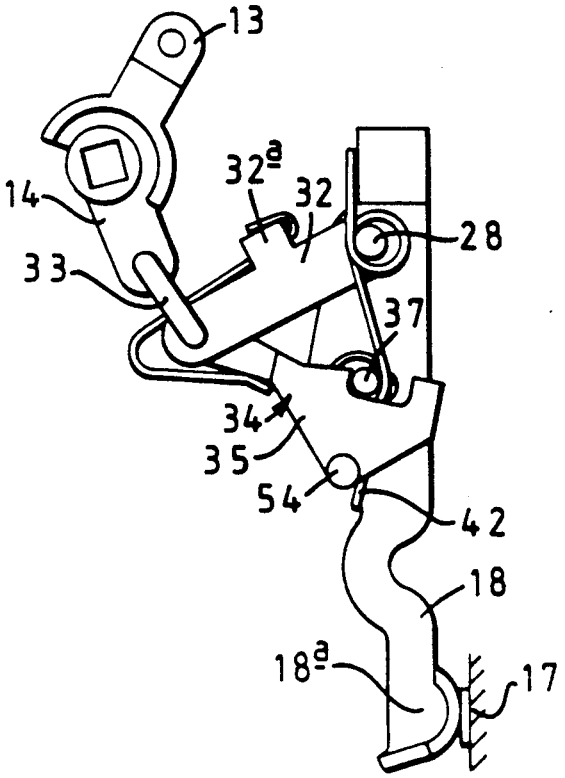

One example of the invention is illustrated in the accompanying drawings wherein, FIG. 1 is a diagrammatic side elevational view of a miniature circuit breaker with one side of the housing thereof removed to expose the mechanism, FIG. 2 is a diagrammatic view of the operating lever, linkage, and moving contact of the circuit breaker shown in FIG. 1, FIG. 2 being to an enlarged scale and illustrating the components in their "OFF" position, FIG. 3 is a view similar to FIG. 2 but illustrating the components in their "ON" position, and FIG. 4 is an enlarged view of the latch and moving contact assembly illustrated in FIGS. 2 and 3, and viewed from above, and FIGS. 5, 6 and 7 are views similar to FIGS. 1, 2 and 3 of a modification.

Referring first to FIGS. 1 to 4 of the drawings, the miniature circuit breaker includes a two part moulded synthetic resin housing 11 the two parts of which, when assembled together, support between them, for pivotal movement, a moulded operating lever assembly 12. The assembly 12 includes a lever 13 projecting externally of the housing and an arm 14 extending internally of the housing, the lever 13 and arm 14 being integral protrusions from a central boss 15 having oppositely directed spigots 16 whereby the assembly 12 is pivotally mounted in the housing. assembly 12 is pivotally mounted in the housing.

The circuit breaker includes a fixed electrical contact 17 engagable by movable electrical contact 18 to complete a circuit through the circuit breaker. The fixed contact 17 is carried on a copper strip 19 shaped to form a fixed part of a screw operated clamping terminal 21. The clamp region 22 of the terminal is accessible, for introduction of a connecting lead, by way of an aperture 23 in one end wall of the housing and the clamping screw 24 of the terminal is accessible by way of an aperture 25 in the wall of the housing from which the lever 13 projects. For convenience the face of the housing from which the lever 13 projects will be referred to as the top face since this is the orientation which it occupies in FIG. 1. However, during use in a consumer unit it is probable that the face from which the lever 13 projects will be orientated as a vertical, front face. Given that the lever projects from the top face of the housing then the opposite region of the housing can be referred to as the base.

Electrically connected to the fixed contacts 17 is a copper coated steel strip 26 which extends downwardly within the housing to the base region thereof and cooperates with a stack 27 of arc dissipation plates of known form. The arc dissipation arrangement is of no significance to the present invention, it being understood that an arc generated as the moving contact 18 disengages from the fixed contact 17 is guided in part by the copper strip 26 into the plate stack 27 where it is dissipated in known manner.

The moving contact 18 is mounted for pivotal movement within the housing, about an axis parallel to the axis of movement of the lever assembly 12, by means of a spindle 28 passing transversly through the upper end region of the moving contact. Movement of the moving contact 18 about the axis of the spindle 28 will move the lower end region 18*a* of the contact 18 into and out of engagement with the fixed contact 17. The end of the moving contact 18 remote from the fixed contact 17 carries a coloured indicator member 29 visible to an operator of the circuit breaker by way of a transparent lens element 31 in the wall of the housing. When the moving contact is in engagment with the fixed contact then conveniently a red area of the indicator member 29 is visible through the lens 31 and when the moving contact 18 is disengaged from the fixed contact 17 conveniently a green area of the indicator 29 is visible through the lens 31. The object of course is to give a visual indication of the operative state of the moving contact.

A rigid metal link member 32 has one end engaged with the spindle 28 so that both the link member 32 and the moving contact 18 are pivotal relative to the housing about the axis of the spindle 28. The end of the link member 32 remote from the spindle 28 is coupled to the arm 14 of the lever assembly 12 by a rigid wire link 33 the wire link 33 being pivotally connected to the arm 14 for pivotal movement about an axis parallel to the axis of movement of the lever assembly 12, and being pivotally connected to the link member 32 for movement about a further axis parallel to the axis of movement of the lever assembly 12. The wire link 33 is generally in the form of a U-shaped element, the two parallel limbs thereof extending through corresponding apertures in the arm 14 and the link member 32 respectively.

A moulded synthetic resin latch member 34 is pivotally connected to the end of the link member 32 remote from the spindle 28 by means of the wire link 33, and thus the latch member 34 is pivotable relative to the link member 32 about the axis of the pivotal connection between the link member 32 and the wire link 33.

The link member 32 is actually a pair of spaced, parallel link plates interconnected by an integral bridging member 32*a*, the moving contact 18 being positioned between the plates at one end of the member 32 and the end region of the moulded latch member 34 extending between the plates of the link member 32 at the opposite end (see FIG. 4). The end of the latch member 34 remote from the link member 32 is enlarged, and is bifurcated to define a pair of intergral, parallel, latch plates 35 between which the moving contact 18 extends. The upper edge of each of the latch plates 35 is formed with a rectangular recess 36 and opposite end regions of a transversly extending, cylindrical, steel pin 37 can be received within the recesses 36. Between the latch plates 35 the pin 37 passes through an elongate slot 38 in the moving contact 18.

A U-shaped wire spring 39 has its base region 41 in contact with the edge of the moving contact 18 remote from the fixed contact 17. The two parallel limbs 42 of the U-shaped spring extend upwardly from their base region 41 on opposite sides of the moving contact 18. The limbs 42 pass between the moving contact 18 and the inner faces of the latch plates 35 and pass to the side of the pin 37 presented towards the fixed contact 17, the limbs 42 contacting the pin 37. Adjacent their free ends the limbs 42 are wound around the spindle 28, and thereafter abut the housing 11. The limbs 42 are wound around the spindle 28 and are engaged with the housing such that the limbs 42 press against the pin 37 and urge the pin 37 in a direction away from the fixed contact 17 (that is to the left in the drawings). As is apparent from the drawings between the spindle 28 and the point of contact of the base 41 with the moving contact 18, the limbs 42 are flexed to pass to one side of the pin 37.

Illustrated diagrammatically in FIGS. 2 and 3, (and in its actual form in FIG. 1) is a spring 43 which acts between the link member 32 and the latch member 34 to pivot the latch member 34 about its interconnection with the link member 32 to move the opposite end of the latch member 34 towards the spindle 28. As is apparent from FIG. 1 the spring 43 is actually a spring of V-shaped configuration, one limb of the "V" engaging the bridge 32*a* of the link member 32 and the other limb of the V engaging the under surface of the latch member 34. The apex of the "V" extends around the pivotal connection of the latch member 34 and link member 32.

It is convenient to first consider manual operation of the circuit breaker, that is to say operation when no fault condition exists in the circuit controlled by the circuit breaker. During such operation movement of the moving contact 18 relative to the fixed contact 17 is controlled solely by manual operation of the lever assembly 12. Moreover, during such operation the latch member 34 does not perform any release function and as will become apparent the pin 37 remains in the recesses 36 of the latch member 34, this position of the latch member 34 relative to the link member 32 being maintained by the spring 43. Referring particularly to FIG. 2 it can be seen that in the "OFF" position the moving contact 18 is pivotted away from the fixed contact 17 and the lever assembly 12 is in a counterclockwise position. The link member 32, the latch member 34, and the moving contact 18 define a substantially rigid triangle pivotable relative to the housing 11 about the spindle 28. As will become apparent in the absence of a fault condition there is substantially no displacement of the three elements of the triangle relative to one another.

In order to move the circuit breaker to its "ON" configuration the lever 13 is moved to the right thus pivotting the lever assembly 12 relative to the housing in a clockwise direction. The consequent movement of the arm 14 is transmitted to the wire link 33 to the triangular configuration of link member 32, latch member 34, and moving contact 18 to pivot this triangular configuration about the axis of the spindle 28 in a counterclockwise direction thus moving the lower end region 18*a* of the moving contact 18 towards the fixed contact 17. The moving contact 18 is actually moved by the base region 41 of the spring 39 pressing against the edge of the contact 18 remote from the fixed contact 17. The spring 39 is pressed by the pin 37 which in turn is being pressed by the latch plates 35 of the latch member 34, the pin 37 being engaged with one end wall of each recess 36. At this stage in the operation, by virtue of the flexure of the limbs 42 of the spring 39 the pin 37 engages the end of the slot 38 in the moving contact 18. However, the arrangement of the components is such that the lower end region 18*a* of the moving contact 18 will engage the fixed contact 17 before the lever 13 has completed its permitted travel relative to the housing. Thus the fixed contact 18 will be arrested at a point when further movement of the lever assembly 12, and therefore the link member 32, link 33, and latch member 34 is still to occur. This final movement of the lever assembly 12 has two effects. Firstly the pivotal axis of the connection between the wire link 33 and the arm 14 passes through a plane containing the axis of movement of the lever assembly 12 and the parallel axis of movement of the wire link 33 relative to the link member 32 and latch member 34, and thus an over-centre action occurs. Secondly, the continued movement of the latch member 34 up to the point at which the connection between the wire link 33 and the arm 14 moves over-centre, causes the pin 37 to move along the length of the slot 38 relative to the fixed contact 18 thereby further stressing the limbs 42 of the spring 39 between the spindle 28 and the base region 41 of the spring. Thus the load which the spring 39 applies to the moving contact 18 is increased thereby ensuring that the moving contact 18 engages the fixed contact 17 with adequate contact pressure.

During manual return movement of the lever assembly 12 from the "ON" position (FIG. 3), to the "OFF" position (FIG. 2) the operation of the components is the reverse of that described above. It will be understood therefore that immediately the pivotal interconnection of the arm 14 and the wire link 33 moves back over-centre the latch member 34 starts to withdraw relative to the fixed contact 18 and the pin 37 is moved by the straightening action of the limbs 42 of the spring 39 back along the length of the slot 38 to engage the end of the slot. Thereafter, the triangle of components comprising the moving contact 18, the link member 32, and the latch member 34 is returned by the spring 39 pressing against the pin 37 and the pin 37 pressing against the end of the slot 38 and against the end of the recesses 36, to the configuration illustrated in FIG. 2. The spring 39 is assisted by return spring 44 of the lever assembly 12 so that if the lever 13 is released immediately the connection between the arm 14 and the wire link 33 has passed over-centre then the springs 39, 44 will return all of the components, including the wire link 33 and the lever assembly 12 to the positions illustrated in FIG. 2. It will be understood that the angular positions of the lever assembly 12 illustrated in FIGS. 2 and 3 are opposite limit positions determined by cooperation between the lever assembly and the housing.

In order to understand the operation of the circuit breaker when a fault condition arises in the circuit controlled by the circuit breaker it is necessary to recognise that the fault condition will give rise to movement of the latch member 34 relative to the link member 32 and the moving contact 18 against the action of the spring 43. The manner in which such movement of the latch member 34 is generated will be described later, after the result of such movement of the latch member 34 has been described.

Assuming that the components are in the position shown in FIG. 3, that it to say the circuit breaker is in its "ON" condition, pivotal movement of the latch member 34 about the connection with the wire link 33 in a direction against the action of the spring 43 will move the latch plates 35 downwardly relative to the pin 37, and thus will disengage the latch plates 35 from the pin 37. Immediately therefore the straightening action of the flexed limbs 42 of the spring 39 will drive the pin 37 to the end of the slot 38 whereafter the spring 39 acting through the pin 37 will pivot the moving contact 18 about the spindle 28 to move the end **18*a* of the moving contact away from the fixed contact 17. It will be understood therefore that the movement of the latch member 34 against the action of the spring 43 releases the moving contact 18 from the remainder of the linkage and thus permits the contacts to open independently of movement of the lever assembly 12 and the linkage components coupled thereto. The contact opening time in a fault situation is thus independent of the inertia of the linkage mechanism for moving the moving contact. It will be recognised for example that even if the lever 13 is held manually in its "ON" position the downward pivotting movement of the latch member 34 against the action of the spring 43 will release the moving contact 18 so that it returns to its "OFF" position even though the lever 13** and the remaining linkage components are held against such movement.

When a fault situation occurs, and the moving contact 18 is disengaged from the remaining linkage components then the return movement of those components to the "OFF" positions is generated by the lever assembly return spring 44, it being recognised that at this point in the operation the spring 39 is no longer in driving engagement with any component other than the moving contact 18 and pin 37. Moreover, the disconnection of the latch member 34 from the pin 37 and therefore from the moving contact 18 disrupts the locking action of the over-centre arrangement such that the spring 44 can return the parts over-centre to their "OFF" positions.

Associated with the moving contact 18 is a clamp type terminal 45 similar to the terminal 21, the terminal 45 being electrically connected to the moving contact 18 through an electromagnet winding 46, the metallic frame 47 of the electromagnet, an elongate bimetal strip 48, and a flexible copper braid 49. The electromagnet winding 46 is wound around an electromagnet pole 51 and an armature 52 is pivotted to the frame 47 of the electromagnet. A spring (not shown) urges the armature 52 away from the pole 51 and when current in excess of a predetermined value flows through the winding 46 the magnetic attraction generated between the pole 51 and the armature 52 overcomes the action of the spring, and the armature 52 pivots towards the pole 51. At its free end the armature 52 includes parallel limbs 53 passing on both sides of the latch member 34 and engaging projecting pegs 54 of the latch member 34. Pivotal movement of the armature 52 towards the pole 51 thus acts through the limbs 53 and the pegs 54 to displace the latch member 34 downwardy against the action of its spring 43 thereby releasing the moving contact 18 for movement to its "OFF" position.

A predetermined bending movement of the bimetal stripe 48 will occur as a result of current in excess of a predetermined value flowing through the bimetal strip 48 for a predetermined length of time. Slidably supported by the housing is a moulded synthetic resin member 55 which is engaged at one end by the bimetal strip 48 and has a wedge at its opposite end, the wedge being located between a limb 53 of the armature 52 and a fixed abutment on the housing. When the bimetal strip 48 bends the moulded synthetic resin member 55 is pushed relative to the housing driving the wedge between the abutment of the housing and the limb 53 of the armature 52 and so displacing the armature 52 towards the pole 51 and thereby moving the latch member 34 downardly against the action of the spring 43 to release the moving contact 18.

It will be recognised therefore that if the fault is such that a large excess of current flows in the circuit breaker then the electromagnetic attraction of the pole 51 and the armature 52 will immediately release the moving contact 18 for return to its open "OFF" position. However, if the fault condition is such that an excess current flows for a predetermined length of time, but at a value too low to operate the electromagnetic release, then after a predetermined length of time sufficient bending of the bimetal strip 48 will occur to duplicate, by means of the wedge end of the member 55, the release movement of the armature 52, thereby releasing the moving contact 18 for return movement to its "OFF" position.

It will be noted that the fixed and movable contacts have substantial lengths parallel to one another and closely spaced in the "ON" position. This arrangement is chosen so that in the event of a massive overload current flowing through the circuit breaker then even before the electromagnetic release 46, 51, 52 can operate the opposing electromagnetic forces generated in the parallel lengths of the fixed and movable contacts will "blow" the moving contact 18 away from the fixed contact 17. Such movement of the moving contact 18 can take place relative to the latch member 34, without release movement of the latch member 34 against the action of its spring 43, by virtue both of the moving contact 18 being positioned between the latch plates 35 of the latch member 34 and the elongate nature of the slot 38 through which the pin 37 extends. The "blow-off" movement of the contact 18 would of course cause increased flexure of the limbs 42 of the spring 39 since the base region 41 of the spring would move with the moving contact 18 but no movement of the pin 37 would occur since the pin 37 would remain in engagement with an end of each recess 36 of the latch member 34.

It will be recognised that during release action generated by bending of the bimetal strip 48, the force generated by the strip 48 must overcome the force of the spring which urges the armature 52 away from the pole 51 of the electromagnetic release. In a modification the moulded synthetic resin member 55 which transmits movement of the bimetal strip 48 is arranged to act directly upon the latch member 34 rather than acting through the intermediary of the limb 53 of the armature 52. In such an arrangement of course the force generated by the armature return spring is irrelevant to bimetal actuation since the bimetal strip would not need to overcome the armature return spring.

It will be recognised also that the use of the spring 39 both as a return spring for the moving contact, and to act in the opposite direction to apply contact pressure in the "ON" condition minimises the number of components needed, and thus simplifies the circuit breaker construction.

It will be recognised from FIG. 1 that the axis of the pole 51, and therefore the axis of the electro-magnetic release arrangement of the circuit breaker is coextensive with the axis of the arc quenching plate stack 27, the plate stack 27 being positioned between the electromagnet arrangement and the base of the housing. Such an arrangement affords a particularly compact circuit breaker construction but is not essential. FIGS. 5 to 7 illustrate a modification applicable to the circuit breakers disclosed above wherein the axis of the electromagnet arrangement is turned through 90° with respect to that of FIGS. 1 to 4.

In FIGS. 5 to 7 parts common to FIGS. 1 to 4 carry the same reference numerals and in general the operation of the contact breaker of FIGS. 5 to 7 is very similar to that described above in relation to FIGS. 1 to 4. However in FIGS. 5 to 7 the armature 52 of the electromagnet 46, 51 is a ferromagnetic rod slidable in the hollow electromagnet pole 51 against the action of a compression spring 51*a*. At its outermost end the armature 52 carries a moulded synthetic resin stirrup 53*a* through which the moving contact 18 extends, the moving contact including a recessed or curved region within the stirrup. In the example of FIGS. 1 to 4 release of the moving contact 18 by the electromagnet 47, 51 is achieved by the limbs 53 of the armature 52 pressing on pegs 54 of the latch member 34 to displace the member 34 downwardly against the action of the spring 43. The same effect is achieved in the example of FIGS. 5 to 7 by the stirrup 53*a* engaging the pegs 54 as the armature 52 is retracted. The pull exerted on the pegs 54 by the stirrup 53*a* causes a downward displacement of the member 34 to release the moving contact 18 for movement of its "OFF" position.

Naturally the moving contact 18 has inertia and since the armature 52 is already retracting as it releases the moving contact 18, the stirrup 53*a* may actually engage the moving contact immediately after release. If this occurs the armature and stirrup will accelerate the movement the contact 18 towards its "OFF" position. The recess or curvature of the moving contact within the stirrup provides a clearance such that initial movement of the armature to actuate the latch member 34 can occur without the stirrup pressing against the moving contact. In a fault situation in which the moving contact 18 has welded to the fixed contact 17 the armature and stirrup, when retracting, will tear the moving contact 18 from the fixed contact 17 so breaking the weld.

Release operation by means of the bimetal strip 48 is identical to that described with reference to FIGS. 1 to 4 with the exception that the wedge of the member 55 acts between the fixed abutment on the housing and the upper surface of the latch member 34.

Rather than the limbs 42 of the spring 39 being flexed in the region of the pin 37 it is preferred, in the example of FIGS. 5 to 7, to loop the spring around the pin 37 in the same manner as is described above in relation to the spindle 28 since this more evenly distributes flexing stress in limbs 42 during operation.

A similar moving contact operating and release structure to those disclosed above could be utilized in circuit breakers other than of the M.C.B. type described above. For example similar structure can be used in a residual current circuit breaker wherein other mechanisms would be incorporated for moving the latch member 34 to release the moving contact 18.

I claim:

1. An improved circuit breaker comprising a fixed contact, a movable contact, resilient means operable to urge the movable contact away from the fixed contact, a manually operable lever for moving the movable contact into and out of engagement with the fixed contact, and a linkage for transmitting movement of said lever to said movable contact and for holding said movable contact in engagement with said fixed contact in an "ON" position of said lever, and, fault detection means for initiating movement of the movable contact away from the fixed contact in a fault situation, the improvement comprising releasable latch means coupling said linkage and said movable contact, including a latch member movable with said linkage, and a pin engageable by said latch member and extending transversely of said moving contact, said pin being movable by said latch member during movement of the linkage towards its "ON" position, and there being a resilient element through which movement of the pin arising from movement of the linkage towards its "ON" position is transmitted to the movable contact to move the movable contact towards the fixed contact, said latch member being disengageable from said pin by operation of said fault detection means whereby to permit movement of the movable contact away from the fixed contact under the action of said resilient means urging the movable contact away from the fixed contact, independently of movement of said linkage.

2. An improved circuit breaker comprising a fixed contact, a movable contact, resilient means operable to urge the movable contact away from the fixed contact, a manually operable lever for moving the movable contact into and out of engagement with the fixed contact, and a linkage for transmitting movement of said lever to said movable contact and for holding said movable contact in engagement with said fixed contact in an "ON" position of said lever, and, fault detection means for initiating movement of the movable contact away from the fixed contact in a fault situation, the improvement comprising releasable latch means coupling said linkage and said movable contact, including a latch member movable with said linkage, and a pin engageable by said latch member and extending transversely of said matling contact, said pin being movable by said latch member during movement of the linkage towards its "ON" position, and (there being a resilient element through which movement of the pin arising from movement of the linkage towards its "ON" position is transmitted to the movable contact to move the movable contact towards the fixed contact), said latch member being disengageable from said pin by operation of said fault detection means whereby to permit movement of the movable contact away from the fixed contact under the action of said resilient means urging the movable contact away from the fixed contact, independently of movement of said linkage, and, the arrangement being such that the movable contact engages the said fixed contact before said linkage reaches its "ON" position, and said resilient element is stressed by movement of the pin after the movable contact engages the fixed contact so as to generate contact pressure.

3. A circuit breaker as claimed in claim 1 wherein said resilient element after disengagement of said latch member from said pin, applies force through said pin to said moving contact to move the moving contact away from the fixed contact.

4. A circuit breaker as claimed in claim 1 wherein said pin extends through an elongate slot in the moving contact.

5. A circuit breaker as claimed in any one of claims 1 to 4 wherein said fault detection means includes an electromagnet which, when energized, actuates said releasable latch means by way of an electromagnet armature.

6. A circuit breaker as claimed in claim 3 wherein the electromagnet is positioned with its axis generally parallel to the length of the moving contact.

7. A circuit breaker as claimed in claim 3 wherein the electromagnet is positioned with its axis generally transverse to the length of the moving contact and said armature is coupled thereto by way of stirrup means whereby the armature can move the moving contact away from the fixed contact.

* * * * *

UNITED STATES PATENT AND TRADEMARK OFFICE

CERTIFICATE OF CORRECTION

PATENT NO. : 5,017,899

DATED : 05/21/91

INVENTOR(S) : Martin Critchley

It is certified that error appears in the above-identified patent and that said Letters Patent is hereby corrected as shown below:

Col. 9,
Claim 1, line 6, delete "moving" and substitute therefor --movable--

Col. 9,
Claim 2, line 34, delete "matling" and substitute therefor --movable--.

Col. 9,
Claim 2, line 36, delete "(there" and substitute therefor --there--.

Col. 10,
Claim 2, line 3, delete "contact)" and substitute therefor --contact--.

Signed and Sealed this

Thirteenth Day of October, 1992

*Attest:*

DOUGLAS B. COMER

*Attesting Officer*

*Acting Commissioner of Patents and Trademarks*